US005941308A

United States Patent [19]

Malone et al.

[11] Patent Number: 5,941,308

[45] **Date of Patent: *Aug. 24, 1999**

[54] FLOW SEGREGATOR FOR MULTI-DRAIN WELL COMPLETION

[75] Inventors: David L. Malone, Sugar Land; Eric E. Neme, Houston, both of Tex.

[73] Assignee: Schlumberger Technology Corporation, Sugar Land, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/769,260

[22] Filed: Dec. 18, 1996

Related U.S. Application Data

[60] Provisional application No. 60/010,656, Jan. 26, 1996.

[51] Int. Cl.[6] ..... E21B 43/14

[52] U.S. Cl. ..... 166/313; 166/50; 166/242.3

[58] Field of Search ..... 166/50, 313, 117.6, 166/117.5, 242.5, 242.3, 54.1

[56] References Cited

U.S. PATENT DOCUMENTS

| | | | |
|---|---|---|---|
| 2,452,920 | 11/1948 | Gilbert | 166/297 |
| 2,797,893 | 7/1957 | McCune et al. | 166/313 |
| 4,415,205 | 11/1983 | Rehm et al. | 166/117.5 |
| 4,573,541 | 3/1986 | Josse et al. . | |
| 5,301,760 | 4/1994 | Graham . | |
| 5,311,936 | 5/1994 | McNair et al. . | |
| 5,318,121 | 6/1994 | Brockman et al. . | |
| 5,318,122 | 6/1994 | Murray et al. . | |
| 5,322,127 | 6/1994 | McNair et al. . | |
| 5,325,924 | 7/1994 | Bangert et al. . | |
| 5,330,007 | 7/1994 | Collins et al. | 166/313 |
| 5,337,808 | 8/1994 | Graham . | |
| 5,353,876 | 10/1994 | Curington et al. . | |
| 5,388,648 | 2/1995 | Jordan, Jr. . | |
| 5,398,754 | 3/1995 | Dinhoble . | |
| 5,411,082 | 5/1995 | Kennedy . | |
| 5,427,177 | 6/1995 | Jordan, Jr. et al. . | |
| 5,435,392 | 7/1995 | Kennedy . | |
| 5,439,051 | 8/1995 | Kennedy et al. . | |
| 5,454,430 | 10/1995 | Kennedy et al. . | |
| 5,458,199 | 10/1995 | Collins et al. . | |
| 5,458,209 | 10/1995 | Hayes et al. . | |
| 5,462,120 | 10/1995 | Gondouin | 166/117.6 |
| 5,472,048 | 12/1995 | Kennedy et al. . | |
| 5,474,131 | 12/1995 | Jordan, Jr. et al. . | |
| 5,477,923 | 12/1995 | Jordan, Jr. et al. . | |
| 5,477,925 | 12/1995 | Trahan et al. . | |
| 5,520,252 | 5/1996 | McNair . | |
| 5,597,042 | 1/1997 | Tubel et al. | 166/250.01 |
| 5,655,602 | 8/1997 | Collins | 166/313 |
| 5,680,901 | 10/1997 | Gardes | 166/313 |
| 5,697,445 | 12/1997 | Graham | 166/313 |

FOREIGN PATENT DOCUMENTS

| | | |
|---|---|---|
| 2 274 864 | 1/1996 | United Kingdom . |
| WO 96/23953 | 8/1996 | WIPO . |

OTHER PUBLICATIONS

Halliburton Advertisement in *Oil & Gas Journal,* May 13, 1996, "Always Raising the Bar in Mulitlateral Technology".

*Primary Examiner*—Hoang C. Dang
*Attorney, Agent, or Firm*—David L. Moseley; James L. Jackson; Wayne I. Kanak

[57] ABSTRACT

A multi-lateral well completion system segregates and prevents commingling of the production fluids flowing from a plurality of lateral wellbores which extend outward from a main wellbore. The system includes a segregator body member that is positioned and oriented in the main wellbore adjacent the inner ends of the lateral wellbores in a manner such that the inlets of separate, longitudinal flow passages in the segregator body member are aligned to receive the production fluid flow from respective lateral wellbores. Various structures are disclosed which provide isolated, pressure-sealed communication between the inner ends of each lateral wellbore and the flow passage inlet that is aligned therewith. Each flow passage in the body member can be equipped with a remotely operated valve to control production fluid flow therethrough, as well as with sensors to monitor various characteristics of the production fluids. Gas lift of the production fluids also can be provided.

28 Claims, 4 Drawing Sheets

FLOW SEGREGATOR FOR MULTI-DRAIN WELL COMPLETION

CROSS-REFERENCE TO RELATED APPLICATION

This application claims priority from U.S. Provisional Application No. 60/010,656, filed Jan. 26, 1996, which is incorporated herein by reference.

BACKGROUND OF THE INVENTION

1. Field of the Invention

This invention relates generally to a flow segregator for use in a well completion where multiple lateral wellbores drain into a central casing, and particularly to a flow segregator that maintains a separation of the fluids being produced from each lateral wellbore so that the production can be monitored and controlled.

2. Description of the Related Art

Downhole systems are known that are located in an underreamed section of a wellbore, and which provide vertically spaced or stacked drain openings for lateral boreholes that extend outward into a plurality of individual formations. Each drain is formed by a relatively short section of pipe that is pivoted at its upper end to a housing that is included in a large diameter, so-called "mother" casing that extends upward to the surface. When an actuator stem is run down inside the mother casing, its lower end pivots the drain sections or subs outward until their central axes are inclined at a known angle to the axis of the housing. Seals are automatically positioned to confine formation fluid flow to the bores of the drain subs. The drain subs are mounted at vertically spaced points along the housing, and can be angularly spaced so as to extend outward at different azimuths.

Once the drain subs are extended and the housing and the mother casing cemented in place, an oriented whipstock is used to deflect a drill bit outward through each drain sub so that a plurality of deviated boreholes can be drilled out into the formations to efficiently drain the same of production fluids. The whipstock also is used to set a liner string of casing in each deviated borehole, which then is cemented in place. The various cased wellbores then can be completed and put on production. The system can be used in connection with newly drilled wells, or for the re-entry of one or more existing lateral wells.

Although the above-described system is highly useful for efficient drainage of certain formations, it has the disadvantage that the production fluids coming in through each drain sub are intermixed and commingled in the housing and the mother casing. If one lateral wellbore is producing mainly salt water, for example, this fluid will contaminate the oil being produced from the other lateral wellbores. It may not be possible to readily determine at the surface which lateral wellbore or formation is producing the salt water. Additionally, there is no effective way to monitor and/or control the respective fluid flow streams to enable remedial action to be taken while maintaining the ability to reenter the multiple laterals without removal of the production hardware.

The general object of the present invention is to provide a new and improved flow segregation apparatus and method of the type described that provides separate flow channels for production fluids from respective lateral wellbores to enable monitoring and/or controlling of the fluids flowing therefrom, so as to obviate the foregoing problems with known systems.

SUMMARY OF THE INVENTION

The above as well as other objects of the present invention are attained through the provision of a flow segregator apparatus that includes an elongated body member having a plurality of angularly spaced flow channels that extend downward therein to progressively deeper levels where a flow inlet to each channel is curved outward through the wall of the body member and axially aligned with a respective drain sub of a previously installed multi-drain assembly. The body member is automatically oriented and stopped during setting by oppositely extending helical guide surfaces on a lower portion of the body member that provide a "mule shoe" which cooperates with an orienting key on the multi-drain housing. Longitudinally spaced packing means above and below each inlet confine fluid flow to the respective flow channels in the body member and prevent intermixing of production fluids.

A control valve can be positioned in the body member near the upper end of each flow channel for the purpose of control and safety, and a measuring instrument package having sensors for pressure, flow, fluid composition and the like can be mounted below the control valve. These elements allow downhole measurements to identify production problems from each wellbore prior to any commingling of the production fluids. The control valve and the instrument package are operated electrically via an electric cable that extends from the top of the body member up through the mother casing to the surface. Individual flow streams can also be brought to the surface by separate production tubing strings that are connected to the top of the segregator body member, or which extend down through the flow channels and into individual drain subs where they are sealed with respect thereto. Extensible conduits also can be used to provide isolated, pressure-sealed communication. Artificial lift of fluids from a particular wellbore also is possible by injection of lift gas via a small diameter line that extends to a regulator valve in the upper portion of the segregator body.

Thus, the present invention provides flow segregation, downhole control and measurement capability, and lateral wellbore reentry for sand clean-out and the like without having to pull any hardware out of the mother casing.

BRIEF DESCRIPTION OF THE DRAWINGS

The present invention has other objects, features and advantages that will become more clearly apparent in connection with the following detailed description of preferred embodiments, taken in conjunction with the appended drawings in which.

DETAILED DESCRIPTION OF PREFERRED EMBODIMENTS

Figure 1:
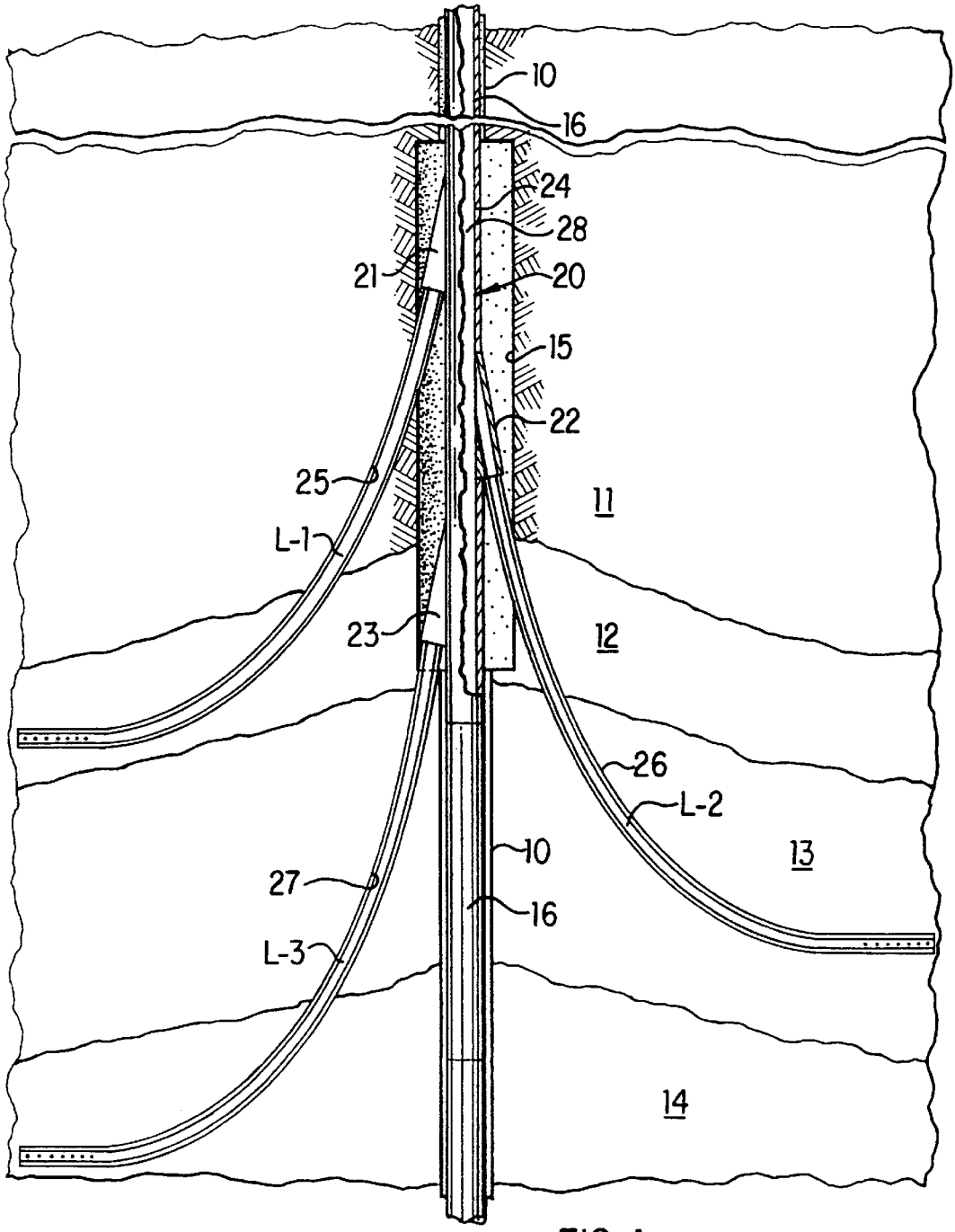
FIG. 1 is a schematic view of a well completed with multiple drain pipes.

Referring initially to FIG. 1, a wellbore 10 has been drilled into the earth through formations 11–14, and the interval 15 has been underreamed to a larger diameter over a discrete length. For example, the wellbore 10 could have a 12¼ inch diameter and the underreamed interval 15 a 26 inch diameter over a length of about 30 feet. A multi-drain system 20 of the type shown and described in PCT Patent Application Number WO 96/23953 is run in on a string of 9⅝ inch casing 16 and positioned within the interval 15, after which an opening sleeve (not shown) is run through the casing and the housing 24 to cause outward pivotal movement of the lower ends of drain subs 21–23 until they lock into place in a sealed manner. When pivoted outward, the respective centerlines of the drain subs 21–23 form a predetermined angle with the central axis of the housing 24, and preferably are angularly spaced at 120° relative to one another, rather than being in the same plane as they are shown for convenience of illustration in FIG. 1. The outer end of each of the drain subs 21–23 is plugged with a drillable material. A cementing string of pipe then is run into the casing 16 with an inflatable packer, and the casing 16 and the multi-drain system 20 are cemented in place in the usual manner.

A whipstock (not shown) then is run on drill pipe and positioned within the housing 24 where it is automatically oriented with its inclined face radially aligned with the upper drain sub 21. A lateral borehole 25 then is drilled on a curved path out into the formation 12, after which a liner string of casing L-1 is set in the lateral borehole 25 and cemented in place. This lateral well can be completed and plugged prior to drilling a second lateral borehole 26 via the drain sub 22. The whipstock is manipulated to align its inclined face opposite the drain sub 22, and lateral borehole 26 is drilled, lined with casing L-2, cemented and completed in the same manner. Finally, the third lateral borehole 27 is drilled, lined with casing L-3, and completed as above, and a production assembly is installed at the surface. The lateral borehole 26 extends into the formation 13, while the lateral borehole 27 enters the formation 14. If the formations are allowed to produce at this point, the production fluids will be commingled within the bore 28 of the housing 24, and the composite fluid production will flow upward to the surface.

Figure 2:
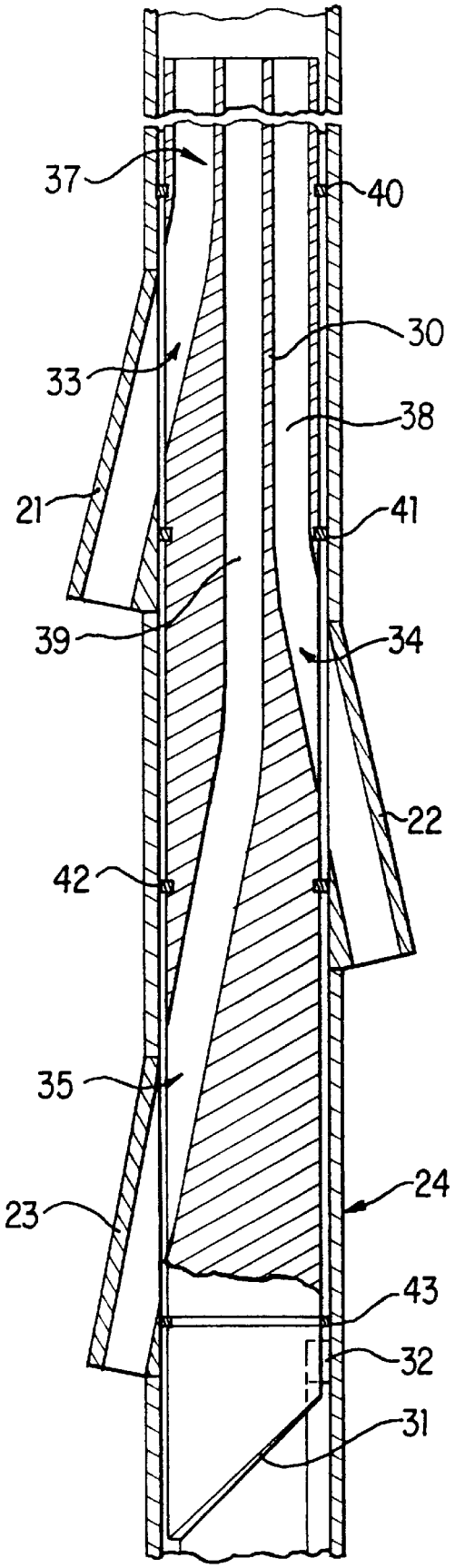
FIG. 2 is an enlarged view showing a flow segregator module or body that is constructed in accordance with the present invention.
Figure 3:
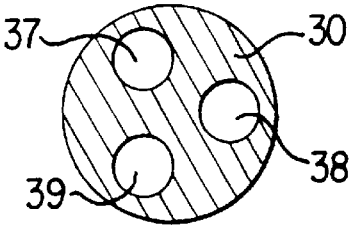
FIG. 3 is a sectional view showing a preferred orientation of bores or flow passages in the segregator body.

As shown in FIG. 2, a flow segregator structure in accordance with the present invention includes an elongated, generally cylindrical segregator body 30 having a "mule shoe" guide 31 at its lower end which cooperates with an orienting key 32 on the multi-drain housing 24 in order to rotationally orient the segregator body 30 so that its inlet openings 33–35 are aligned with the bores of the respective drain subs 21–23. For convenience of illustration, the drain subs 21–23 are shown in FIG. 2 as being arranged in the same longitudinal plane. In practice, as noted above, the subs 21–23 preferably are angularly offset from one another. Each of the inlet openings 33–35 communicate with the downward and outwardly curved lower end portions of respective longitudinal bores 37, 38, 39 which extend upward in the segregator body 30 to an outlet at the upper end thereof. As shown in FIG. 3, the hores 37, 38, 39 are angularly offset relative to each other by 120 degrees to permit maximum bore sizes within the cross-section of the segregator body 30. Of course a construction where the drain subs 21–23 and the inlet openings 33–35 are in a single plane could be used, however the sizes of the bores 37–39 would have to be reduced, or be inclined in the segregator body 30 so as to open at the top end thereof in the orientation shown in FIG. 3. It will be recognized that other numbers of the bores 37–39 than that shown could be used, depending upon the configuration of the associated multi-drain system 20.

A pair of vertically spaced seals 40, 41, which for example can be in the form of O-rings, expansible packing elements, chevron packings, or other similar devices, engage between the segregator body 30 and the surrounding inner wall of the multidrain system housing 24 to confine fluids coming into the inlet opening 33 to the bore 37. In the same manner, additional pairs of seals 41, 42 and 42, 43 confine fluids coming into the inlet openings 34, 35 to the respective bores 38 and 39. Thus the production fluid streams are not commingled with:in the multi-drain system housing 24 as in the prior system.

Figure 4:
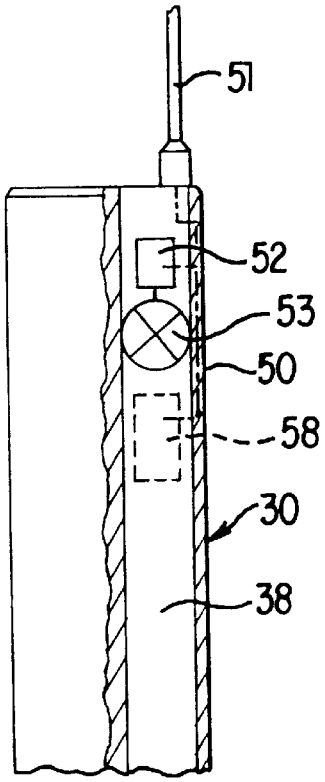
FIG. 4 is a right-side sectional view of the upper end portion of the segregator body, and showing schematically a flow control valve and a sensor package that can be used.

As shown in FIG. 4, the upper portion 50 of the segregator body 30 can be equipped with flow control devices and sensors that are associated with each of the bores 37–39 to allow independent control of the flow rates from each lateral wellbore, as well as the monitoring of flow rate, pressure and fluid being produced by each lateral wellbore. In an exemplary embodiment, a control valve 53, whose actuator 52 is operated electrically in response to signals from a control cable 51 that extends upward to the surface, can be used to control the rate of fluid flow through the bore 38. Conductors in the cable 51 also extend to a sensor package 58 which is located below the control valve 53. The sensor package 58 includes sensors which detect fluid pressure, flow and composition, as well as other characteristics, so that signals representative of such measurements can be telemetered to the surface via the cable 51. Each of the other bores 37, 39 is provided with a control valve and a sensor package as shown in FIG. 4 for the bore 38, and these devices also are operated and monitored via the cable 51. If the flow of production fluids at the surface indicates that there may be a problem with the production flow from one or more of the lateral wellbores, the control valve 53, for example, can be selectively closed to allow various measurements to be made to determine the nature and extent of such problems so that appropriate remedial action can be undertaken.

Figure 5:
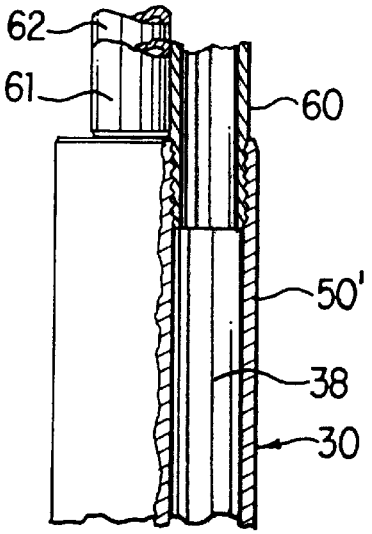
FIG. 5 is another view of the upper end portion of the segregator body and showing multiple strings of production tubing attached thereto.

FIG. 5 illustrates another embodiment of an upper portion 50' of the segregator body 30 where multiple strings of production tubing 60–62 which extend upward to the surface are threaded, latched into or otherwise secured to the top end thereof. In this case, the production fluid from the various lateral wellbores cannot commingle in the casing 16, but are brought up to the surface through separate tubing strings. Various instruments (not shown) at the surface are used to monitor the flow from each lateral wellbore.

Figure 6:
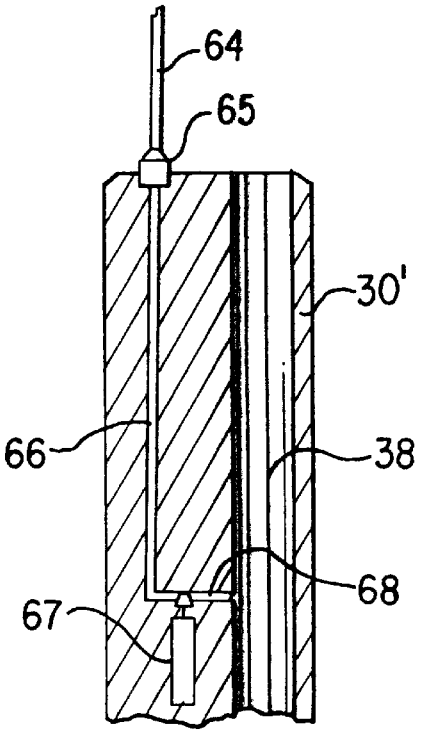
FIG. 6 is a sectional view similar to FIG. 4, but illustrating the use of gas lift.

FIG. 6 shows a system where the production from each lateral wellbore can be put on gas lift in the event its bottomhole pressure drops to the extent that this type of artificial lift would be desirable. A small diameter line 64 extends from a surface compressor down to a connection 65 at the top of the segregator body 30' so that lift gas under pressure can be supplied via passage 66 to a gas lift valve 67 that will open at a certain set pressure value. When the gas lift valve 67 is open, gas is injected into the bore 38 through a port 68 to reduce the density of the produced fluids and thereby increase the fluid flow rate. Each of the other bores 37 and 39 in the segregator body 30' can be equipped with a similar lift gas injection system.

Figure 7:
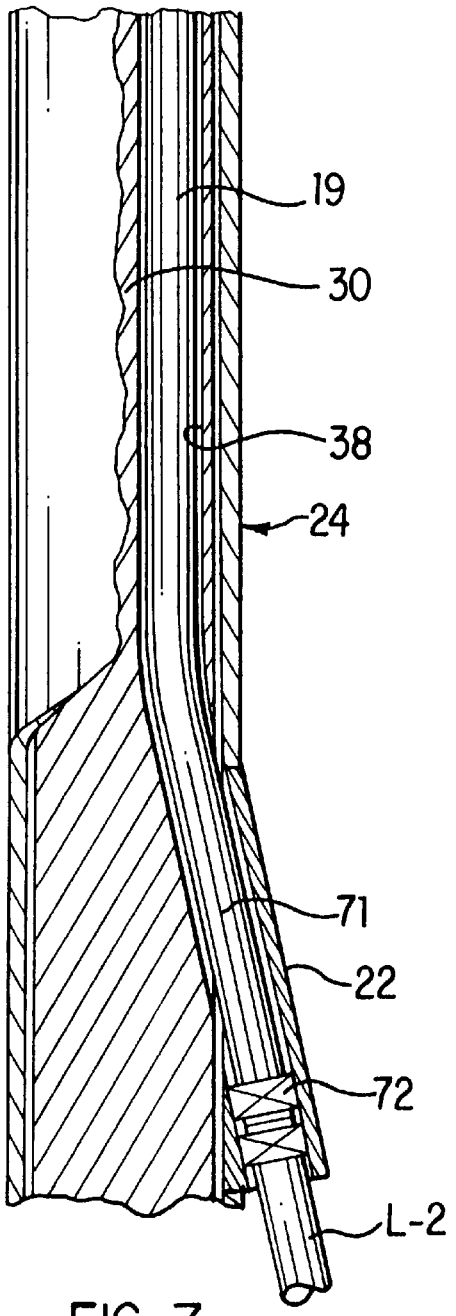
FIGS. 7 and 8 are cross-sectional views, with some parts in side elevation, which illustrate additional structural arrangements of the present invention to ensure segregation of the flow of production fluids from different lateral wellbores.

FIG. 7 shows an alternate system to provide isolated communication between the lower end of a production tubing 19 and a respective one of the drain subs 21–23, for example the drain sub 22. The lower end portion 71 of the production tubing 19 is guided into the appropriate outlet at the top of the segregator body 30, and positioned so that such lower end portion extends into the drain sub 22 as shown. A packer 72, which can be an inflatable device located near the lower end of the production tubing 19, is set inside the bore of the drain sub 22 by appropriate expansion to provide an isolated fluid flow path via the production tubing 19 to the surface. The respective pairs of seals 40–43 shown in FIG. 2 need not be used, but can be used if redundant seals are desirable.

Figure 8:
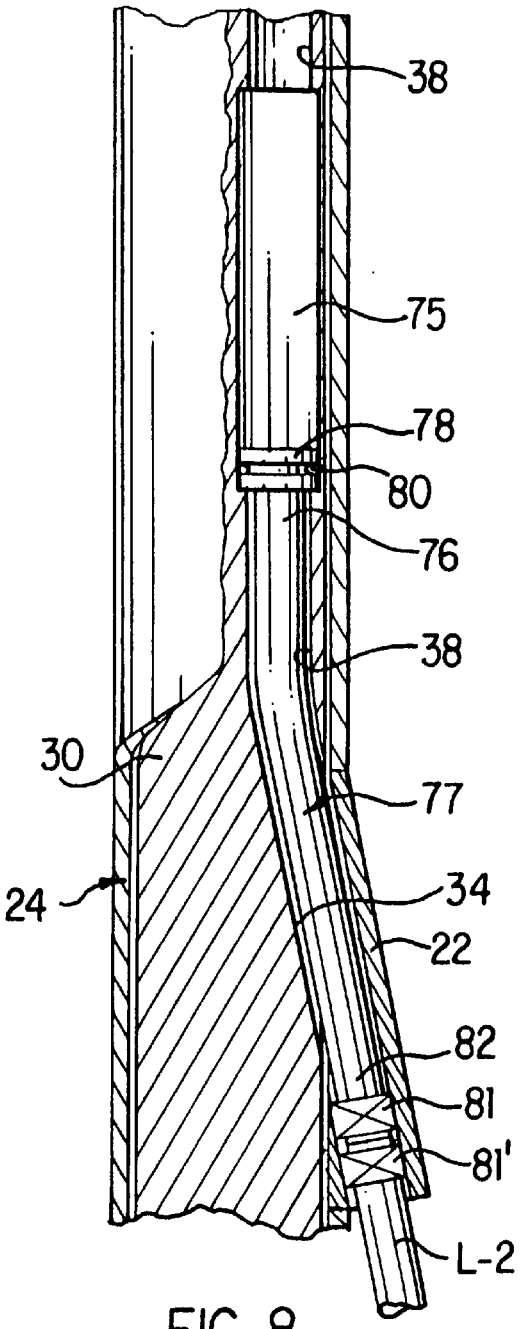

FIG. 8 illustrates another means of providing isolated, pressure sealed communication between the inner end of a lateral wellbore and a longitudinal flow passage in the segregator body 30, for example the bore 38 which communicates with the casing L-2 via the drain sub 22. Since each of these structures is identical, only the communication means for the casing L-2 will be described in detail. As shown, an extensible pipe member or conduit 77 is slidably arranged in the bore 38 and in the inlet opening 34 for movement between an upper position where the lower end portion 82 thereof is retracted through the inlet opening 34, and a lower position where such lower end portion is pushed into the bore of the drain sub 22. In the upper position of the pipe member 77, its lower end portion 82 is totally within the segregator body 30 so that the body can be lowered into the housing 24. An outwardly directed annular shoulder 78 on the upper end 76 of the pipe member 77 slides within an enlarged diameter section 75 of the bore 38, and carries a seal ring 80 that prevents fluid leakage. A suitable sealing means 81, such as an inflatable packer element, is arranged on the lower end portion 82 of the pipe member 77, and seals against the bore of the drain sub 22 when the pipe member is fulled extended. A similar sealing means 81' is arranged on the upper end of casing L-2. The pipe member 77 can be forced from its upper or running position to its lower or extended position by any suitable means such as a setting tool that is run on tubing. When extended, the pipe member 77 and the seal ring 80 and sealing means 81, 81' provide isolated, pressure sealed communication between the upper end of the casing L-2 and the bore 38 in the segregator body 30. Isolated communication between the other casings L-1 and L-3 and the respective bores 37 and 39 in the segregator body 30 is provided in the same manner as shown in FIG. 8.

OPERATION

In operation and use, the wellbore 10 is drilled and underreamed at the section 15 as shown in FIG. 1, and then the multi-drain system 20 is lowered into the section 15 on the casing 16. The lateral drain subs 21–23 are retracted into the multi-drain system housing 24 during running. An expander sleeve or packer is lowered into the housing 24 to pivot the drain subs 21–23 so that they incline downward and outward as shown. A cementing string and a packer (not shown) then are used to cement the casing 16 and the multi-drain system 20 in place in the wellbore 10. Next a whipstock, also not shown, is run on drill pipe and positioned inside the multi-drain system 20, and is automatically oriented by its mule shoe guide and by the lug or orienting key 32 (FIG. 2) on the housing 24 so that its inclined kick-off face is radially aligned with the drain sub 21. A lateral borehole 25 then is drilled below drain sub 21 which curves outward and into a target formation. The outer section of the borehole can extend horizontally, if desired. Borehole 25 then is lined with casing which is cemented in place. After repositioning and orienting the whipstock opposite the remaining two drain subs 22, 23, two additional lateral horeholes 26, 27 are drilled into the respective formations 13 and 14, and these boreholes are cased with liners that are cemented in place.

The segregator body 30 of the present invention then is lowered into place within the multi-drain system housing 24 on drill pipe, coiled tubing or the like, and is automatically oriented by the mule shoe surfaces 31 and the orienting key 32 so that the inlet openings 33–35 in the segregator body 30 register with the bores of the respective drain subs 21–23. The various pairs of seals 40,41, 41,42 and 42,43 will confine production fluids from the lateral boreholes 25–27 to the respective bores 37, 38 and 39 in the segregator body 30. Then each lateral borehole 25–27 can be put on production.

In the event of any indication that one or more of the lateral boreholes 25–27 is not producing the fluid composition that is expected, or that any other production or well problem has arisen, the electrical control cable 51 (FIG. 4) is employed to close selected ones of the control valves 53, and surface readouts from the sensor packages 58 are monitored in order to diagnose the problem so that appropriate remedial action can be taken. Since the respective production fluid flows are not commingled below the level of the control valves 53, a diagnosis is much more certain than when using prior multi-drain systems. Alternatively, the multiple production tubing arrangement shown in FIG. 5 can be used so that the control valves 53 can be located at the surface. The structure shown in FIG. 6 can be used to put one or more of the lateral boreholes 25–27 on gas lift when needed. The previously described segregator body 30 is pulled, and the segregator body 30' is run in order to accomplish artificial lift. The operation and use of the alternative means shown in FIGS. 7 and 8 to provide isolated, pressure sealed communication between the lateral boreholes and the bores 37–39 in the segregator body 30 via the drain subs 21–23 is set forth above.

The concepts of the present invention are seen as being independent of the particular manner in which the lateral boreholes 25–27 are made or formed. A lateral borehole in which a liner string of casing is employed as described herein, is but one implementation. However, the system described could also be used where the lateral boreholes 25–27 are open-hole completions, as well as for other types of completions.

It now will be recognized that a new and improved flow segregating apparatus has been disclosed for use in a well completion where multiple boreholes are drained through a central well. Downhole flow control and measurements are facilitated to enable identification of production problems. Any one of the lateral boreholes can be reentered and serviced without pulling any of the apparatus from the well. Since certain changes or modifications may be made in the disclosed embodiments without departing from the inventive concepts involved, it is the aim of the following claims to cover all such changes and modifications that fall within the scope of the present invention.

What is claimed is:

1. A well completion system for use in segregating the flows of production fluids from a plurality of lateral wellbores, comprising: a tubular housing having a plurality of angularly spaced drain means on the walls thereof, each of said drain means being arranged to receive production fluids from a lateral wellbore; flow segregating body means being positioned at a selected orientation in said housing; flow passage means in said flow segregating body means having inlet means aligned with each of said drain means, and having longitudinal passages extending upward from each of said inlet means and opening through the upper end of said flow segregating body means; and isolating means providing pressure-sealed communication between said drain means and said inlet means.

2. The well completion system of claim 1 further including valve means for controlling the flow of production fluids through each of said longitudinal passages.

3. The well completion system of claim 2 further including means for sensing a characteristic property of the production fluids present in each of said longitudinal passages.

4. The well completion system of claim 3 further including means for operating said valve means and said sensor means from the top of the well.

5. The well completion system of claim 1 further including means on said flow segregating body means and said tubular housing for positioning said flow segregating body means at a predetermined angular orientation in said tubular housing so that said inlet means are aligned with said drain means.

6. The well completion system of claim 5 wherein said positioning means includes helical guide surfaces on said flow segregating body means cooperable with key means on said tubular housing to automatically orient said flow segregating body means so that said drain means and said inlet means are aligned.

7. The well completion system of claim 1 wherein each of said longitudinal passages has a lower portion that is curved outward to provide a smooth transition to an adjacent drain means.

8. The well completion system of claim 1 further including means in said flow segregating body means for injecting lift gas into the production fluids flowing through a respective one of said flow passage means to place a lateral wellbore producing therethrough on gas lift.

9. The well completion system of claim 1 wherein said isolating means comprises annular seal means engaging between said flow segregating body means and said tubular housing above and below each of said inlet means.

10. The well completion system of claim 1 wherein said isolating means comprises conduit means extending through each of said longitudinal passages in said flow segregating body means and into respective ones of said drain means.

11. The well completion system of claim 10 wherein said conduits are movable from retracted positions within said flow segregating body means to extended positions where lower end portions of said conduits extend into adjacent drain means.

12. The well completion system of claim 11 further comprising first seal means for preventing fluid leakage between said conduits and said flow segregating body means and second seal means for preventing fluid leakage between said conduits and said drain means.

13. A well completion apparatus for use in segregating the flows of production fluids from a plurality of lateral wellbores having their inner ends in communication with a main wellbore, comprising: a generally cylindrical flow segregating body means adapted to be lowered into said main wellbore to a location adjacent said inner ends; flow passage means in said flow segregating body means including inlet means adapted to be aligned with said inner ends and to receive production fluid flow therefrom, isolating seal means establishing pressure sealed flow paths between said inner ends of said lateral wellbores and said inlet means, passages extending upwardly in said flow segregating body means from said inlet means and opening through the upper end of said flow segregating body means, and orientation means on said flow segregating body means for positioning said inlet means to receive production fluid flow from said inner ends of said lateral wellbores.

14. The well completion apparatus of claim 13 wherein said passages have upper and lower portions, said lower portions being curved outward to provide smooth transitions to said inner ends of said lateral wellbores.

15. The well completion apparatus of claim 14 further comprising valve means in said upper portions of said passages for controlling the flow of production fluids through said passages.

16. The well completion apparatus of claim 15 further comprising means for sensing a characteristic property of the production fluids present in each of said passages.

17. The well completion apparatus of claim 16 further comprising means for operating said valve means and said sensing means from the top of said main wellbore.

18. A well completion apparatus for use in segregating the flows of production fluids from a plurality of lateral wellbores having their inner ends in communication with a main wellbore, comprising: a generally cylindrical flow segregating body means adapted to be lowered into said main wellbore to a location adjacent said inner ends, flow passage means in said flow segregating body means having inlet means adapted to be aligned with said inner ends and to receive production fluid flow therefrom, passages extending upwardly in said flow segregating body means from said inlet means and opening through the upper end of said flow segregating body means, orientation means on said flow segregating body means for positioning said inlet means to receive production fluid flow from said inner ends of said lateral wellbores, and isolating means for providing pressure-sealed flow paths between said inner ends of said lateral wellbores and said inlet means and isolating said pressure-sealed flow paths from one another.

19. The well completion apparatus of claim 18 wherein said isolating means comprises annular seal means on said flow segregating body means above and below each of said inlet means.

20. The well completion apparatus of claim 18 wherein said isolating means comprises conduits movable from retracted positions in said flow segregating body means to extended positions, said conduits in said extended positions having outer portions that extend outwardly of said flow segregating body means.

21. The well completion apparatus of claim 20 further comprising means for preventing fluid leakage between said conduits and said body means in the said extended positions of said conduits.

22. A method of segregating the flows of production fluids from a plurality of lateral wellbores having their inner ends in communication with a main wellbore that extends upward to the surface, comprising the steps of: positioning multidrain housing means within said main wellbore, lowering a generally cylindrical flow segregating body means into said main wellbore to a location within said multidrain housing means and adjacent said inner ends; providing flow passage means in said flow segregating body means comprising inlet means adapted to be aligned with said inner ends and to receive production fluid therefrom, said flow passage means comprising passages that extend upwardly in said flow segregating body means from said inlet means to the upper end of said body means; rotationally orienting said flow segregating body means within said multidrain housing means to position said inlet means to receive production fluid flow from said inner ends of said lateral wellbores; and establishing sealed and isolated production fluid flow communication between said inner ends of said lateral wellbores and said inlet means.

23. The method of claim 22 including the further step of controlling the flow of production fluids through said flow passage means.

24. The method of claim 23 including the further step of sensing a characteristic property of production fluids present in each of said passages.

25. The method of claim 22 including the further step of providing isolated, pressure-sealed communication between said inner ends of said lateral wellbores and said inlet means.

26. A well completion apparatus for use in segregating the flows of production fluids from a plurality of lateral wellbores having their inner ends in communication with a main wellbore, comprising: a tubular multi-drain housing adapted for positioning within said main wellbore and having a plurality of angularly spaced drain means, each of said drain means adapted for receiving production fluids from a lateral wellbore, a generally cylindrical flow segregating body means adapted to be lowered into said main wellbore to a location within said tubular multi-drain housing and adjacent said inner ends, flow passage means in said flow segregating body means comprising inlet means adapted to be aligned with said inner ends and to receive production fluid flow therefrom and passages extending upwardly in said body means from said inlet means and opening through the upper end of said body means, orientation means on said body means for positioning said inlet means to receive production fluid flow from said inner ends of said lateral wellbores, and isolating seal means establishing sealing between said tubular multi-drain housing and said flow segregating body means and isolating each of said inlet means from one another and providing pressure-sealed flow paths between said inner ends of said lateral wellbores and said inlet means.

27. The well completion apparatus of claim 26 wherein said isolating seal means comprises sealing means establishing sealing of said inlet means to said body means and establishing sealing of said inlet means to said inner ends of said lateral wellbores.

28. The well completion apparatus of claim 26 wherein said isolating seal means comprises housing seal means establishing sealing of said flow segregating body means with said tubular multi-drain housing and isolating said angularly spaced drain means from one another, said isolating seal means having inlet seal means establishing sealing of said inlet means to said inner ends of said lateral wellbores and establishing sealing of said inlet means to said flow segregating body means.

* * * * *